US007241960B2

(12) United States Patent
Gill et al.

(10) Patent No.: US 7,241,960 B2
(45) Date of Patent: Jul. 10, 2007

(54) INTEGRATED SNAP-BACK NOISE SUPPRESSION SWITCH

(75) Inventors: Mark A. Gill, Russiaville, IN (US); Chris R. Snider, Kokomo, IN (US); David J. Clute, Cicero, IN (US)

(73) Assignee: Delphi Technologies, Inc., Troy, MI (US)

( * ) Notice: Subject to any disclaimer, the term of this patent is extended or adjusted under 35 U.S.C. 154(b) by 127 days.

(21) Appl. No.: 11/216,744

(22) Filed: Aug. 31, 2005

(65) Prior Publication Data

US 2007/0045096 A1 Mar. 1, 2007

(51) Int. Cl.
*H01H 1/10* (2006.01)

(52) U.S. Cl. ..... 200/517; 200/512; 200/520; 200/341

(58) Field of Classification Search ..... 200/512–517, 200/341, 520, 5 A, 302.2
See application file for complete search history.

(56) References Cited

U.S. PATENT DOCUMENTS 5,399,821 A * 3/1995 Inagaki et al. ..... 200/341
5,718,326 A * 2/1998 Larose et al. ..... 200/314
6,300,582 B1 * 10/2001 Huang ..... 200/302.2
6,495,780 B1 * 12/2002 Tucci et al. ..... 200/302.1
6,610,943 B1 * 8/2003 Durfee et al. ..... 200/302.1
6,633,986 B1 * 10/2003 Sellers ..... 713/300
6,756,968 B2 * 6/2004 McAlindon ..... 345/169

* cited by examiner

*Primary Examiner*—K. Lee
(74) *Attorney, Agent, or Firm*—Jimmy L. Funke

(57) ABSTRACT

A button assembly comprising a panel having a hole and a button configured to extend through the hole. The assembly further includes an integral switch pad and gasket member, with the switch pad having a base and a flexible dome including a contact extending from the base. The gasket member is integrally connected to the switch pad at a transition line and includes an opening. The button is configured to be placed through the hole in the panel and the gasket member is configured to be repositioned relative to the switch pad along the transition line such that the opening in the gasket member is aligned with the hole in the panel and the button engages the gasket member. The flexible dome of the switch pad is configured to be aligned with the hole in the panel such that depression of the button collapses the dome of the switch pad.

20 Claims, 6 Drawing Sheets

INTEGRATED SNAP-BACK NOISE SUPPRESSION SWITCH

TECHNICAL FIELD

The present invention concerns control assemblies, and more particularly relates to control assemblies having an integrated snap-back noise suppression switch.

BACKGROUND OF THE INVENTION

Control assemblies using buttons can be used in a wide variety of applications. For example, buttons can be used in vehicles to control a radio, air conditioning or many other features. Furthermore, the control assemblies can typically be used in any application that has switches actuated by buttons.

Heretofore, control assemblies have included buttons that, when depressed, force depression of a flexible dome having a contact to force the contact into connection with at least one corresponding contact on a circuit board to close a circuit on the circuit board. However, when the button is released, the button can make a clacking type sound when the button moves back to its base position as the button engages the structure surrounding the button that keeps the button in position on the control assembly. Typically, gaskets have been placed either in the interface area between the button and the surrounding structure, on the button, or on the surrounding structure. However, it has been difficult to position the gaskets because the gaskets are small and flimsy due to the thinness of the gasket. Furthermore, the size of the gasket does not allow for an identifier like a component part number.

Accordingly, an apparatus is desired having the aforementioned advantages and solving and/or making improvements on the aforementioned disadvantages.

SUMMARY OF THE INVENTION

An aspect of the present invention is to provide a button subassembly comprising a switch pad and a gasket member. The switch pad has a base and at least one flexible dome extending from the base, with the at least one flexible dome including at least one contact. The gasket member is integrally connected to the switch pad. The gasket member comprises at least one extension having an opening. The gasket member and the switch pad have a transition line therebetween. The gasket member is configured to be moved relative to the switch pad along the transition line and repositioned during use such that the at least one opening is aligned with at least one flexible dome.

Another aspect of the present invention is to provide a button assembly comprising a panel having a hole therethrough, a button configured to extend through the hole in the panel, and an integral switch pad and gasket member. The switch pad has a base and a flexible dome extending from the base. The flexible dome includes a contact. The gasket member is integrally connected to the switch pad at a transition line, with the gasket member comprising at least one extension having an opening. The button is configured to be placed through the hole in the panel and the gasket member is configured to be repositioned relative to the switch pad along the transition line such that the opening in the gasket member is aligned with the hole in the panel and the button engages the gasket member. The flexible dome of the switch pad is configured to be aligned with the hole in the panel such that depression of the button collapses the flexible dome of the switch pad.

Yet another aspect of the present invention is to provide a method of assembling a button assembly comprising providing a panel having a hole therethrough, with the hole having a front and a rear, providing a button, and providing an integral switch pad and gasket member. The switch pad has a base and a flexible dome extending from the base. The flexible dome includes a contact. The gasket member is integrally connected to the switch pad at a transition line. The gasket member comprises at least one extension having an opening. The method further includes extending the button through the hole in the panel, repositioning the gasket member relative to the switch pad along the transition line, aligning the opening of the gasket member with the rear of the hole of the panel, and aligning the flexible dome of the switch pad with the button such that depression of the button will depress the flexible dome.

These and other aspects, objects, and features of the present invention will be understood and appreciated by those skilled in the art upon studying the following specification, claims, and appended drawings.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
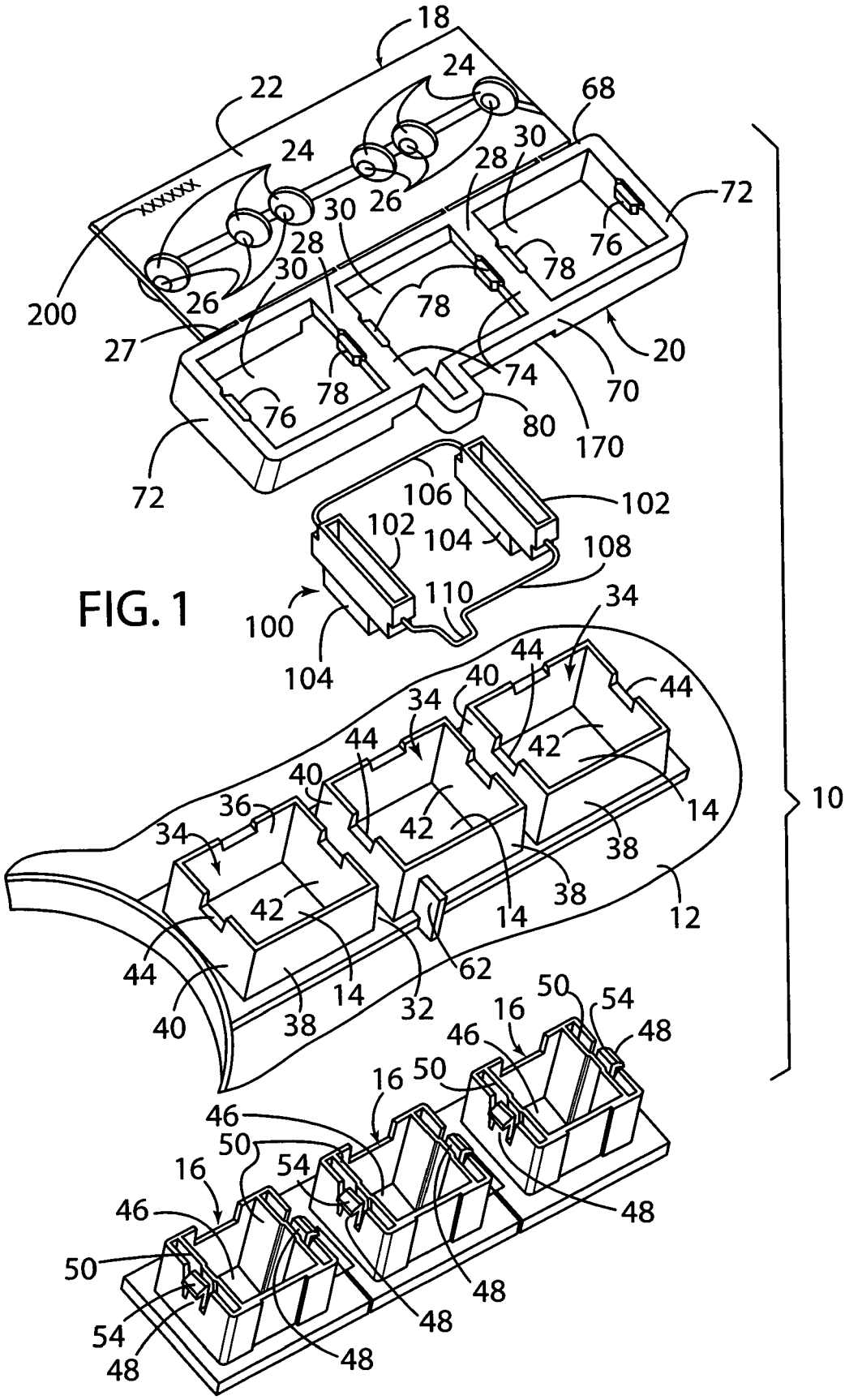
FIG. 1 is a rear isometric exploded view of a button assembly of the present invention.

For purposes of description herein, orientation terms shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a button assembly embodying the present invention. In the illustrated example, the button assembly 10 comprises a panel 12 having a hole 14 therethrough, a button 16 configured to extend through the hole 14 in the panel 12, and an integral switch pad 18 and gasket member 20. The switch pad 18 has a base 22 and a flexible dome 24 extending from the base 22. The flexible dome 24 includes a contact 26. The gasket member 20 is integrally connected to the switch pad 18 at a transition line 27, with the gasket member 20 comprising at least one extension 28 having an opening 30. The button 16 is configured to be placed through the hole 14 in the panel 12 and the gasket member 20 is configured to be repositioned relative to the switch pad 18 along the transition line 27 such that the opening 30 in the gasket member 20 is aligned with the hole 14 in the panel 12 and the button 16 engages the gasket member 20. The flexible dome 24 of the switch pad 18 is configured to be aligned with the hole 14 in the panel 12 such that depression of the button 16 collapses the flexible dome 24 of the switch pad 18.

In the illustrated embodiment, the panel 12 can comprise any panel 12 that could include the button 16. For example, the panel 12 could be located on the dashboard of a vehicle and could include controls for a stereo or air conditioning. However, the panel 12 could be located anywhere and in any article. The panel 12 includes at least one hole 14 having the button 16 therein. In the illustrated embodiment, the panel 12 includes three holes 14 each having one button 16 therein. However, it is contemplated that the panel 12 could have any number of holes 14. Furthermore, in the illustrated embodiment, the holes 14 have a rectangular periphery. However, it is contemplated that the holes 14 could have any peripheral shape. The holes 14 are preferably located in a depression 32 in the front face of the panel 12. However, it is contemplated that the holes 14 do not have to be located in the depression 32. A rear face of the panel 12 includes three rectangular flanges 34 extending rearwardly therefrom, with the rectangular flanges 34 defining a periphery of the holes 14. The rectangular flanges 34 include a top wall 36, a bottom wall 38, a first side wall 40 and a second side wall 42. The first side wall 40 and the second side wall 42 preferably each include a notch 44 for accepting a portion of the gasket member 20 and the button 16 as described in more detail below. Like the holes 14, while the flanges 34 are illustrated as being rectangular, it is contemplated that the flanges 34 could have any peripheral shape. Furthermore, it is contemplated that the flanges 34 could not have the notches 44 or could have any number of notches 44. The illustrated panel 12 further includes an alignment flange 62 extending from one of the rectangular flanges 34 for aligning elements of the button assembly 10 as discussed below. The holes 14 of the panel 12 have the buttons 16 therein.

Figure 2:
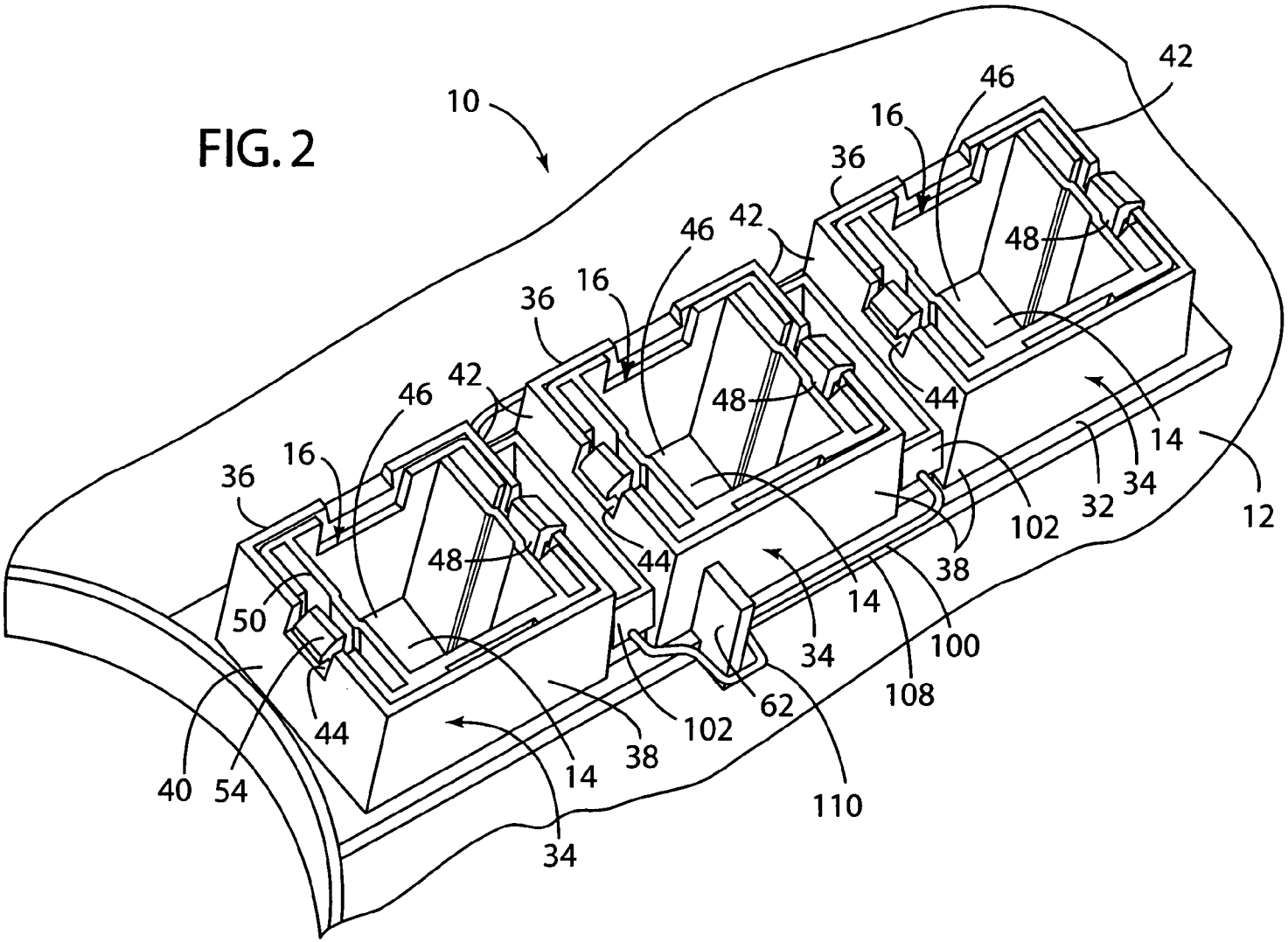
FIG. 2 is a rear isometric view of a panel, buttons and a decorative trim insert of the button assembly of the present invention in a first assembly position.
Figure 5:
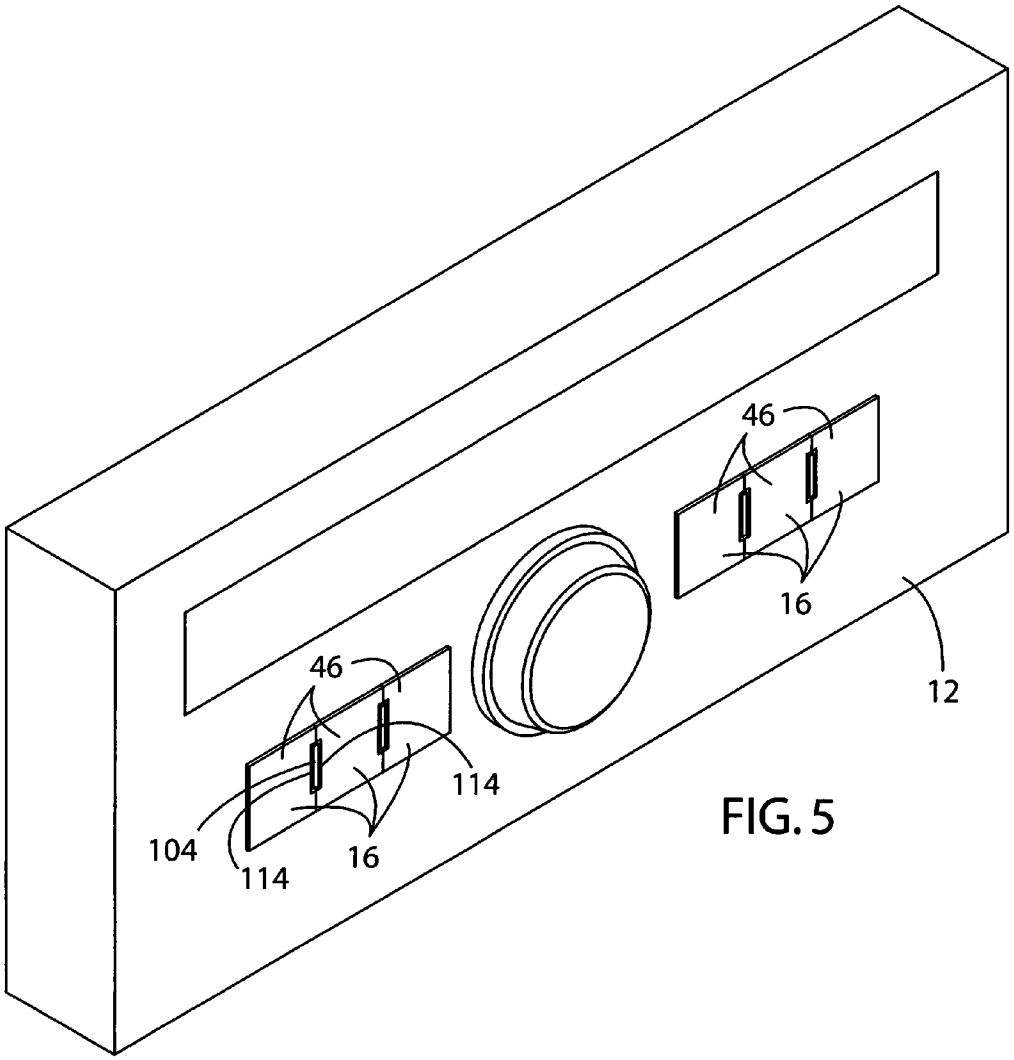
FIG. 5 is a front isometric view of the button assembly of the present invention.

The illustrated buttons 16 are located in the holes 14 of the panel 12 and are configured to slide within the holes 14 of the panel 12. The buttons 16 include a face 46 (see FIG. 5), a rearwardly extending projection 48 and at least one actuation projection 50. In the illustrated embodiment, the rearwardly extending projection 48 is rectangular and has an outside periphery coextensive with an inside periphery of the hole 14 and the rectangular flange 34 of the panel 12. However, it is contemplated that the rearwardly extending projection 48 could have any peripheral shape, although the peripheral shape of the reawardly extending projection 48 is preferably the same shape as the flange 34 of the panel 12. A pair of side walls 52 of the rearwardly extending projection 48 each includes a resilient hook 54. As the button 16 is initially slid into the hole 14 of the panel 12 from the front of the panel 12, the resilient hooks 54 bend inward against the first side wall 40 and the second side wall 42 of the rectangular flange 34 of the panel 12. Once the buttons 16 are fully inserted into the holes 14, the resilient hooks 54 will snap outward to maintain the buttons 16 in the holes 14. FIG. 2 illustrates the buttons 16 in the panel 12 at a first assembly position of the button assembly 10. In the illustrated embodiment, the at least one actuation projection 50 comprises a member 56 extending between a bottom wall 58 and a top wall 60 of the rearwardly extending projection 50. While two actuation projections 50 are shown, it is contemplated that any number of actuation projections 50 having any shape or configuration could be used. The actuation projections 50 are configured to depress the flexible dome 24 of the switch pad 18 when the buttons 16 are depressed. Furthermore, the buttons 16 do not have to have the enlarged face 46 and could be inserted into the openings 14 through the rear of the panel 12.

Figure 4:
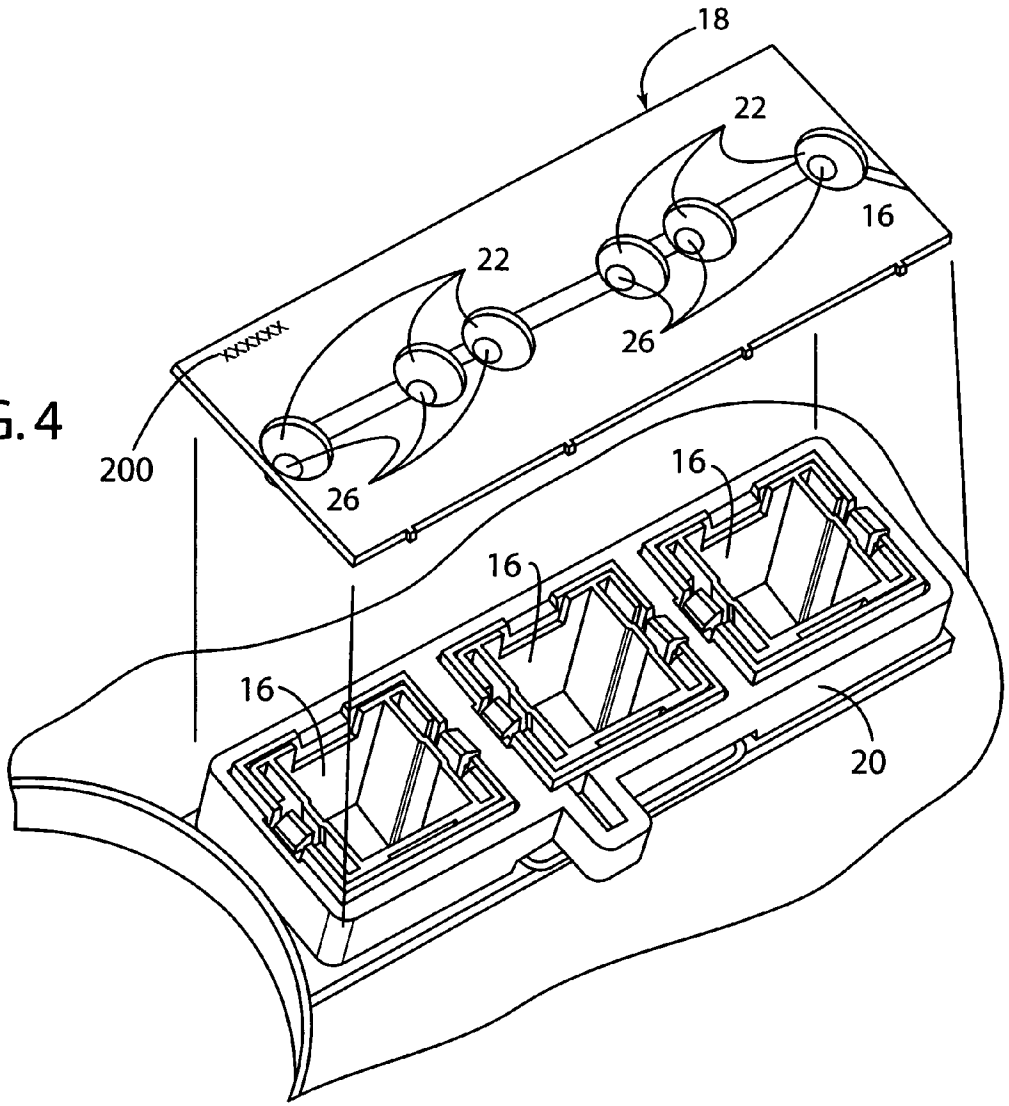
FIG. 4 is a rear isometric view of the button assembly of the present invention in a third assembly position.

In the illustrated embodiment, the switch pad 18 is located at a rear of each of the holes 14 in the panel 12 and includes the base 22 and the flexible dome 24 extending from the base 22. The flexible dome 24 includes the contact 26. The switch pad 18 is preferably made of a flexible material, and preferably from an elastomeric material. For example, the switch pad 18 can be made of rubber. Accordingly, the flexible dome 24 can be depressed to allow the contact 26 of the flexible dome 24 to contact at least one corresponding contact 64 on a circuit board 66 (see FIG. 6) as is well known to those skilled in the art to close a circuit on the circuit board 66. For example, the circuit on the circuit board 66 could change a station on a radio, change a radio between AM and FM, change the temperature on air conditioning or actuate anything. It is contemplated, however, that the flexible dome 24 could be more flexible than the remainder of the switch pad 18. Furthermore, the contact 26 can comprise any conductive material. For example, the contact 26 can be formed integrally with the flexible dome 24, with the flexible dome 24 or a portion thereof being made of a conductive material, such as conductive rubber. Alternatively, the contact 26 could comprise a conductive element connected to the flexible dome 24. For example, the contact 26 could comprise a carbon disc or pill. In the illustrated example, the button 16 depresses the flexible dome 24 to close the circuit on the circuit board 66. As illustrated in FIG. 4, the switch pad 18 includes a pair of the flexible domes 24 for each button 16, with one flexible dome 24 for each actuation projection 50 of each button 16. However, it is contemplated that the switch pad 18 could include any number (including only one) of the flexible domes 24 for each button 16. Furthermore, while the button assembly 10 is shown as including one switch pad 18 with a plurality of flexible domes 24 for interaction with a plurality of the buttons 16, it is contemplated that there could be only one switch pad 18 for each button 16.

Figure 6:
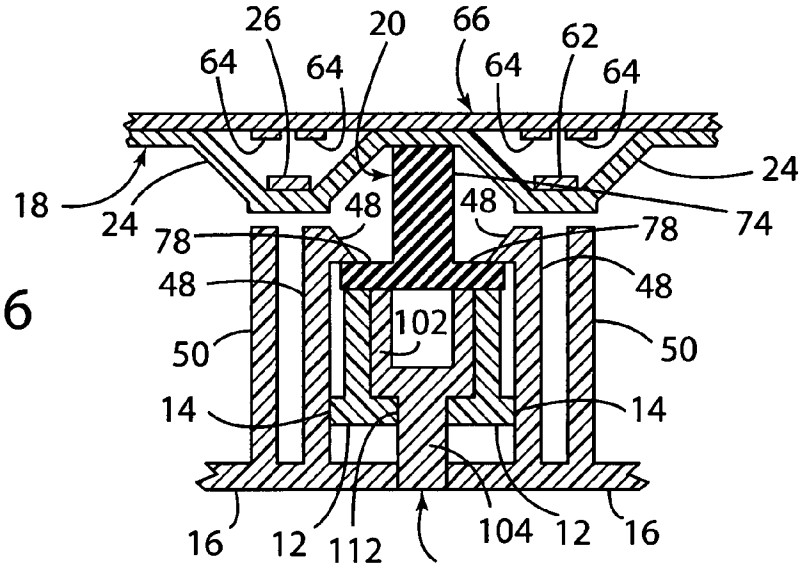
FIG. 6 is a cross-sectional view of the button assembly of the present invention in a final assembly position.

The illustrated the gasket member 20 is located between the resilient hooks 54 of the buttons 16 and the rectangular flange 34 of the panel 12 (see FIG. 6). The gasket member 20 comprises the extension 28 having the opening 30. In the illustrated embodiment, the extension 28 includes three openings 30. However, it is contemplated that the extension 28 could include any number of openings 30. The extension 28 comprises a top wall 68, a bottom wall 70, a pair of side walls 72 and a plurality of spanning walls 74. As illustrated in FIG. 1, the spanning walls 74 are thinner than the top wall 68, the bottom wall 70 and the pair of side walls 72. In the illustrated example, the bottom wall 70 includes an alignment notch 80 extending downwardly from the central opening 30. Each of the side walls 72 includes a side noise suppression flange 76 extending inwardly from a top surface thereof. Furthermore, each of the spanning walls 74 includes a pair of central noise suppression flanges 78 extending outwardly in an opposite direction from a top surface thereof. The side noise suppression flanges 76 and the central noise suppression flanges 78 suppress noise made by the buttons 16 engaging the rectangular flange 34 of the panel 12.

In the illustrated example, the gasket member 20 is positioned between the panel 12 and a portion of the button 16 to suppress noise. To assemble the button assembly 10, the gasket member 20 is engaged with the panel 12 by sliding the gasket member 20 over the rectangular flanges 34 of the panel 12 such that the rectangular flanges 34 are located within the openings 30 in the gasket member 20. To assist in properly positioning the gasket member 20 on the panel 12, the alignment flange 62 extending from one of the rectangular flanges 34 of the panel is slid into the alignment notch 80 of the extension 28 of the gasket member 20. Once the gasket member 20 is fully engaged with the panel 12, the side noise suppression flanges 76 will rest in notch 44 of the first side wall 40 of a first one of the outermost rectangular flanges 34 and the notch 44 of the second side wall 42 second one of the outermost rectangular flanges 34. Furthermore, the central noise suppression flanges 78 will rest in the remaining notches 44 of the first side walls 40 and the second side walls 42 of the rectangular flanges 34. Thereafter, the buttons 16 are inserted into the holes 14 in the panel 12 through the front of the panel 12. As described above, once the buttons 16 are fully inserted into the holes 14, the resilient hooks 54 will snap outward to maintain the buttons 16 in the holes 14. In the illustrated embodiment, the side noise suppression flanges 76 and the central noise suppression flanges 78 are located between the first side walls 40 and the second side walls 42 of the rectangular flanges and the resilient hooks 54 of the buttons 16 inside the notches 44 of the first side walls 40 and the second side walls 42. Furthermore, the switch pad 18 is repositioned relative to the gasket member 20 by tearing the switch pad 18 and gasket member 20 along the transition line 27 and repositioning the switch pad 18 over the gasket member 20 as illustrated in FIG. 4. The tearing can take place before or after the gasket member 20 is in position on the panel 12. Preferably, the transition line 27 comprises a perforation or a line of weakened material to facilitate the tearing.

During use, the circuit on the circuit board 66 is closed by depressing one of the buttons 16, thereby depressing at least one of the flexible domes 24 on the switch pad 18 and engaging the contact 26 with a pair of corresponding contacts on the circuit board 66 (see FIG. 6). When the button 16 is released, the at least one of the flexible domes 24 will flex outward, thereby biasing the button 16 back outward through the hole 14 in the panel 12. Once the at least one of the flexible domes 24 moves the button 14 back to its base position, the resilient hooks 54 of the button 16 will abut against one of the side noise suppression flanges 76 and one of the central noise suppression flanges 78 or a pair of the central noise suppression flanges 78 (or a pair of the side noise suppression flanges 76 if the gasket member 20 is associated with only one button 16 and one hole 14 in the panel 12). Therefore, the noise suppression flanges 76, 78 will suppress the noise of the resilient hooks 54 as the buttons 16 move back to the base position.

Figure 3:
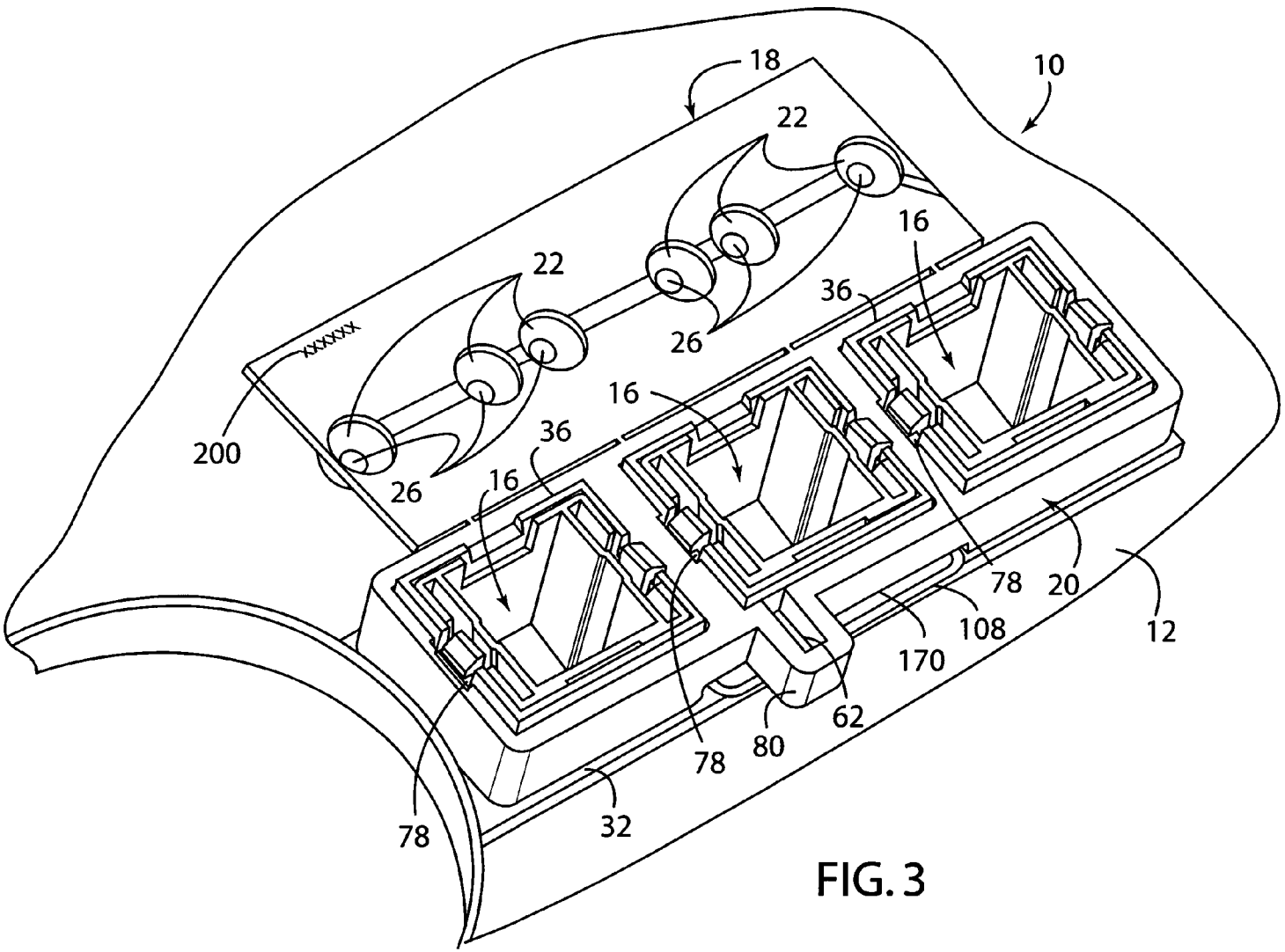
FIG. 3 is a rear isometric view of the button assembly of the present invention in a second assembly position.

In the illustrated example, it is contemplated that the button assembly 10 could include a decorative trim insert 100. The decorative trim insert 100 includes a pair of bases 102, a rectangular extension 104 extending from the bases 102, a top connection member 106 and a bottom connection member 108 (see FIG. 1). The bases 102 are configured to be positioned between the second side wall 42 of the left most rectangular flange 34 and the first side wall 40 of the central rectangular flange 34 as well as the second side wall 42 on the central rectangular flange 34 and the first side wall 40 of the right most rectangular flange 34 as illustrated in FIG. 2. The bottom connection member 108 includes a channel portion 110 for accepting the alignment flange 62 therein to ensure proper alignment of the decorative trim insert 100. The rectangular extensions 104 of the decorative trim insert 100 extend through small openings 112 located between the openings 14 in the panel 12 (see FIGS. 5 and 6). The rectangular extensions 104 extend through the small openings 112 such that a front face of the rectangular extensions 104 is flush with the faces 46 of the buttons 16 when the buttons 16 are in the base position. The faces 46 of the buttons 16 include grooves 114 for accepting the rectangular extensions 104. Furthermore, the bottom wall 70 of the gasket member 20 preferably includes a channel 170 for accepting the bottom connection member 108 therein as illustrated in FIG. 3. Although the decorative trim insert 100 is illustrated as including two bases 102 and rectangular extensions 104, it is contemplated that the decorative trim insert 100 could include any number of bases 102 and rectangular extensions 104. Preferably, the decorative trim insert 100 includes one base 102 and one rectangular extension 104 for every pair of adjacent buttons 16. Furthermore, it is contemplated that the bases 102 and the extensions 104 could have any shape.

Figure 7:
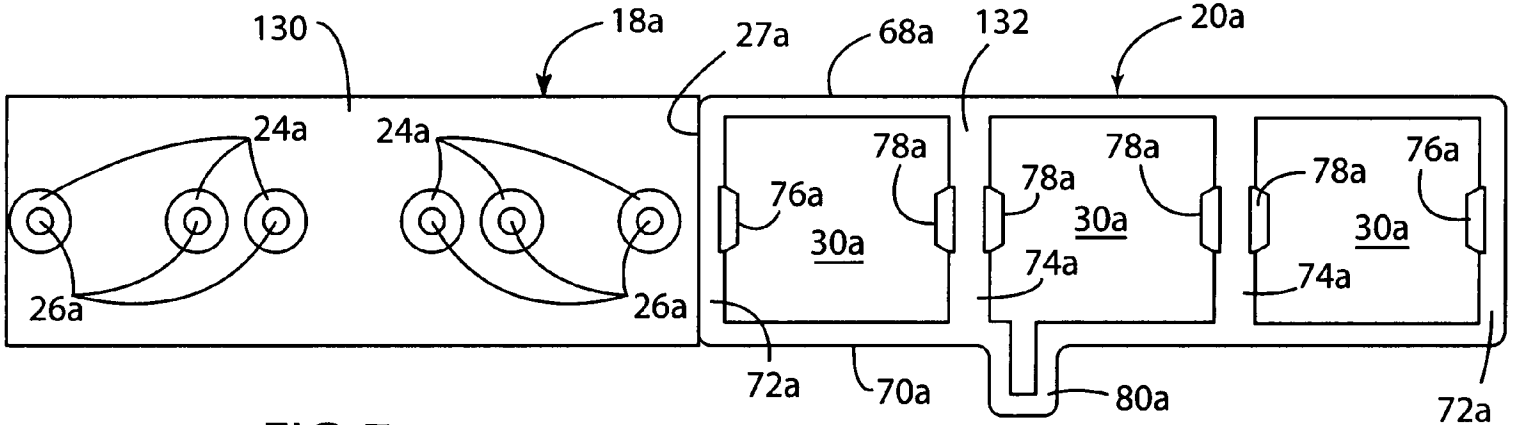
FIG. 7 is a top view of a second embodiment of an integral switch pad and gasket member of the present invention.

The reference numerals 18*a* and 20*a* (FIG. 7) generally designate another embodiment of the present invention, having a second embodiment for the integral switch pad and gasket member. Since integral switch pad 18*a* and gasket member 20*a* is similar to the previously described integral switch pad 18*a* and gasket member 20*a*, similar parts appearing in FIGS. 1–6 and FIG. 7, respectively, are represented by the same, corresponding reference number, except for the suffix "a" in the numerals of the latter. In the second embodiment of the integral switch pad 18*a* and the gasket member 20*a*, the switch pad 18*a* is connected to the gasket member 20*a* along a transition line 27*a* that is located between one of the side walls 72*a* of the gasket member 20*a* and a side of the base 22*a* of the gasket member 20*a*. Instead of separating the gasket member 20 and the switch pad 18 as described above in the first embodiment of the integral switch pad 18 and gasket member 20, the integral switch pad 18*a* and gasket member 20*a* of the second embodiment of the present invention is used by folding the switch pad 18*a* along the transition line 27*a* such that a bottom face 130 of the switch pad 18*a* is abutted against a top face 132 of the gasket member 20*a*. Preferably, the transition line 27*a* comprises a line of weakened material to facilitate the folding. Therefore, while in the first embodiment of the gasket member 20 and the switch pad 18, the flexible domes 24 can extend either upward or downward when connected to the gasket member 20, the second embodiment of the integral switch pad 18*a* and the gasket member 20*a* preferably has the flexible domes 24*a* extending in such a way that they abut the top face 132 of the gasket member 20*a* when the switch pad 18*a* is folded over onto the gasket member 20*a*.

Accordingly, according to the button assembly 10 of the present invention, a noise suppression member is located between the buttons 16 and an interface area on the panel 12 to suppress the noise that the buttons 16 make after actuation. Furthermore, the gasket member 20 is relatively sturdy to allow for easy handling during assembly of the button assembly 10. Moreover, the size of the integral switch pad 18 and gasket assembly 20 allows an identifier or part number 200 (see FIG. 1) to be easily placed anywhere thereon.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. A button subassembly comprising:

a switch pad having a base and at least one flexible dome extending from the base, the at least one flexible dome including at least one contact; and a gasket member integrally connected to the switch pad, the gasket member comprising at least one extension having an opening;

the gasket member and the switch pad having a transition line therebetween;

wherein the gasket member is configured to be moved relative to the switch pad along the transition line and repositioned during use such that the opening is aligned with at least one at least one flexible dome.

2. The button subassembly of claim 1, wherein:

the transition line comprises a perforation to allow the gasket member to be removed from the switch pad.

3. The button subassembly of claim 1, wherein:

the transition line comprises a line of weakened material to allow the switch pad to be folded over the gasket member.

4. The button subassembly of claim 1, wherein:

the at least one extension comprises a plurality of extensions, each extension defining a closed periphery having the opening therein.

5. The button subassembly of claim 4, wherein:

the openings are rectangular and the extensions include at least one flange extending into the openings.

6. A button assembly comprising:

a panel having a hole therethrough;

a button configured to extend through the hole in the panel; and an integral switch pad and gasket member, the switch pad having a base and a flexible dome extending from the base, the flexible dome including a contact, the gasket member being integrally connected to the switch pad at a transition line, the gasket member comprising at least one extension having an opening;

wherein the button is configured to be placed through the hole in the panel and the gasket member is configured to be repositioned relative to the switch pad along the transition line such that the opening in the gasket member is aligned with the hole in the panel and the button engages the gasket member; and wherein the flexible dome of the switch pad is configured to be aligned with the hole in the panel such that depression of the button collapses the flexible dome of the switch pad.

7. The button assembly of claim 6, wherein:

the transition line comprises a perforation to allow the gasket member to be removed from the switch pad.

8. The button assembly of claim 6, wherein:

the transition line comprises a line of weakened material to allow the switch pad to be folded over the gasket member.

9. The button assembly of claim 6, wherein:

the button includes at least one hook for maintaining the button within the hole of the panel.

10. The button assembly of claim 9, wherein:

the panel includes a projection surrounding the hole;

the at least one hook is configured to engage the projection to maintain the button in the hole.

11. The button assembly of claim 10, wherein:

the extension includes at least one flange extending into the openings, the at least one flange being located between the hook and the projection.

12. The button assembly of claim 6, wherein:

the button includes at least one actuation member configured to engage the flexible dome to depress the flexible dome.

13. A method of assembling a button assembly comprising:

providing a panel having a hole therethrough, the hole having a front and a rear;

providing a button;

providing an integral switch pad and gasket member, the switch pad having a base and a flexible dome extending from the base, the flexible dome including a contact, the gasket member being integrally connected to the switch pad at a transition line, the gasket member comprising at least one extension having an opening;

extending the button through the hole in the panel;

repositioning the gasket member relative to the switch pad along the transition line;

aligning the opening of the gasket member with the rear of the hole of the panel; and aligning the flexible dome of the switch pad with the button such that depression of the button will depress the flexible dome.

14. The method of assembling a button assembly of claim 13, further including:

perforating a line between the gasket member and the switch pad;

wherein repositioning the gasket member relative to the switch pad comprises tearing the gasket member and the switch pad along the transition line.

15. The method of assembling a button assembly of claim 13, further including:

providing a line of weakened material between the switch pad and the gasket member;

wherein repositioning the gasket member relative to the switch pad comprises folding the switch pad along the line of weakened material.

16. The method of assembling a button assembly of claim 13, wherein:

the button includes at least one hook for maintaining the button within the hole of the panel.

17. The method of assembling a button assembly of claim 16, wherein:

the panel includes a projection surrounding the hole;

further including engaging the hook with the projection to maintain the button in the hole.

18. The method of assembling a button assembly of claim 17, wherein:

the extension includes at least one flange extending into the opening, the at least one flange being located between the hook and the projection.

19. The method of assembling a button assembly of claim 13, wherein:

the button includes at least one actuation member configured to engage the flexible dome to depress the flexible dome.

20. The method of assembling a button assembly of claim 13, further including:

placing an identifier on the integral switch pad and gasket member.

* * * * *